United States Patent [19]

Tomita et al.

[11] Patent Number: 4,657,074

[45] Date of Patent: Apr. 14, 1987

[54] HEAT EXCHANGER FOR COMBUSTION HEATER

[75] Inventors: Itizo Tomita; Eiji Okura, both of Konan, Japan

[73] Assignee: Diesel Kiki Co., Ltd., Tokyo, Japan

[21] Appl. No.: 830,883

[22] Filed: Feb. 19, 1986

[30] Foreign Application Priority Data

Feb. 27, 1985 [JP] Japan ..... 60-27763[U]

[51] Int. Cl.[4] ..... F28F 1/42

[52] U.S. Cl. ..... 165/179; 165/183

[58] Field of Search ..... 165/146, 183, 179

[56] References Cited

U.S. PATENT DOCUMENTS

| | | | |
|---|---|---|---|
| 1,048,186 | 12/1912 | Lomschakow | 165/183 |
| 1,519,673 | 12/1924 | Doble | 165/179 |
| 2,188,133 | 1/1940 | Hepburn | 165/179 |
| 2,362,571 | 11/1944 | McCollom | 165/179 |
| 2,978,797 | 4/1961 | Ekelund | 165/179 |
| 3,267,564 | 8/1966 | Keyes | 165/179 |

FOREIGN PATENT DOCUMENTS

| | | | |
|---|---|---|---|
| 881486 | 4/1943 | France | 165/179 |
| 447241 | 3/1968 | Switzerland | 165/183 |

*Primary Examiner*—William R. Cline
*Assistant Examiner*—Richard R. Cole
*Attorney, Agent, or Firm*—Wenderoth, Lind & Ponack

[57] ABSTRACT

A heat exchanger suitable for use with a combustion heater, comprises a one-piece extruded tubular heat exchanger element having a tubular body and a number of interior and exterior fins projecting integrally radially from the tubular body.

5 Claims, 5 Drawing Figures

HEAT EXCHANGER FOR COMBUSTION HEATER

BACKGROUND OF THE INVENTION

1. Field of the Invention

The present invention relates to a heat exchanger for use with a combustion heater for effecting the heat exchange between air and hot combustion gases.

2. Prior Art

There are known various heat exchangers used with combustion heaters for effecting the heat exchange between air and hot combustion gases generated by burning gaseous or liquid fuels. Known heat exchangers generally include a tubular body, a number of interior fins disposed on the inner periphery of the tubular body and a number of exterior fins disposed on the outer periphery of the tubular body, thereby providing a large heat transfer surface area which in turn leads to a high heat exchange efficiency.

Typical examples of such known heat exchangers are disclosed in Japanese Patent Laid-open Publication Nos. 59-134496 and 59-173654. The heat exchanger disclosed in the first-mentioned Japanese publication includes a tubular body having a plurality of interior fins extending longitudinally thereof and projecting radially inwardly from the inner peripheral surface of the tubular body, and a plurality of exterior fins force-fitted over the outer periphery of the tubular body at angular intervals. The heat exchanger shown in the last-mentioned Japanese publication comprises a tubular body with a plurality of interior and exterior fins extending longitudinally thereof, the exterior fins being formed by cutting the material of the body itself.

Due to an additional working process required for forming the exterior fins, the disclosed heat exchangers are costly to manufacture and cannot be produced at a high rate. Furthermore, with the non-integral, force-fitted exterior fins, the two-piece heat exchanger such as shown in the first-mentioned Japanese publication has only a limited heat transfer efficiency due to a high thermal resistance at the joint between the body and the exterior fins. To improve the heat exchange efficiency, a large heat exchanger body is needed and thus a compact and light combustion heater is difficult to achieve.

SUMMARY OF THE INVENTION

It is accordingly an object of the present invention to provide a heat exchanger suitable for use with a combustion heater in which the heat exchanger can be manufactured easily at low cost and can provide a high heat exchange efficiency.

Another object of the present invention is to provide a heat exchanger having structural feature which enable the heat exchanger to be manufactured through a single working process.

The foregoing and other objects of the present invention are attained by a heat exchanger for use with a combustion heater for effecting the heat exchange between air and combustion heat generated by a combustion device of the combustion heater, the heat exchanger comprising: a one-piece extruded heat exchanger element including a tubular body, a plurality of interior fins extending longitudinally of the tubular body and projecting integrally radially inwardly from the inner periphery of the tubular body, and a plurality of exterior fins extending longitudinally of the tubular body and projecting integrally radially outwardly from the outer periphery of the tubular body.

With the integral formation of the heat exchanger body and the interior and exterior fins through a single extrusion process, the heat exchanger has a high heat transfer efficiency and can be manufactured efficiently at a low cost.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
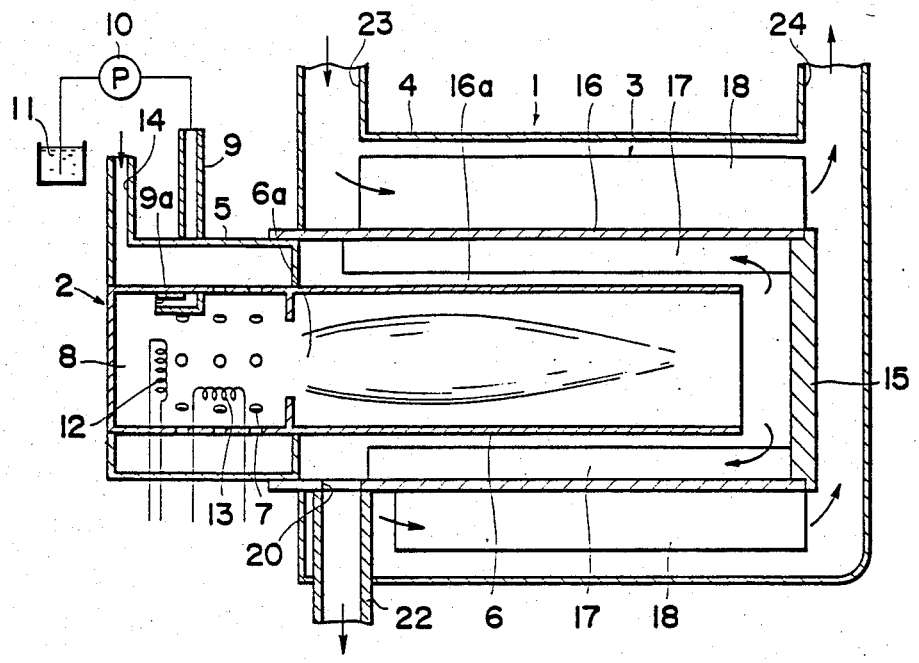
FIG. 1 is a schematic longitudinal cross-sectional view of a combustion heater employing a heat exchanger constructed in accordance with the present invention.

As shown in FIG. 1, a combustion heater 1 comprises a combustion device 2, a heat exchanger 2 associated with the combustion device 2, and a casing 4 in which the heat exchanger 2 is housed.

The combustion device 2 includes a combustion tube 6 extending throughout the length of the combustion device 2 and defining therein an elongate combustion chamber 6*a*. The combustion chamber 6*a* has an open end (righthand in FIG. 1) and a closed end (lefthand in the same figure). A wick 8 of glass fibers or asbestos is disposed in the combustion chamber 6*a* adjacent to the closed left end thereof. A fuel supply tube 9 is connected to the combustion chamber 6*a* and has a discharge opening 9*a* facing the wick 8 for supplying a liquid fuel, such as naphtha, kerosine or light oil, to the wick 8.

The combustion tube 6 has a number of air inlet holes 7 defined therein adjacent to the wick 8 which introduce outside air into the combustion chamber 6*a*. A hollow cylindrical air intake tube 5 is disposed around the left end portion of the combustion tube 6, there being defined between the tubes 6, 5 an annular chamber (not designated) communicating with the combustion chamber 6*a* through the air inlet holes 7. The outside air supplied in the air intake tube 5 through an air supply tube 14 connected thereto.

A fuel supply pump 10 is connected to an intake opening of the fuel supply tube 9 for supplying the fuel from a tank 11 to the wick 8 through the fuel supply tube 8. A heater 12 is disposed on an outer surface of the wick 8 for vaporizing the fuel supplied to the wick 8. An ignition coil 13 is disposed in the combustion chamber 6*a* adjacent to the wick 8 for lighting the vaporized fuel. The ignition coil 13, the heater 12 and the fuel supply pump 10 is controlled by a suitable control unit (not shown) to maintain a surtable combustion condition.

Figure 2:
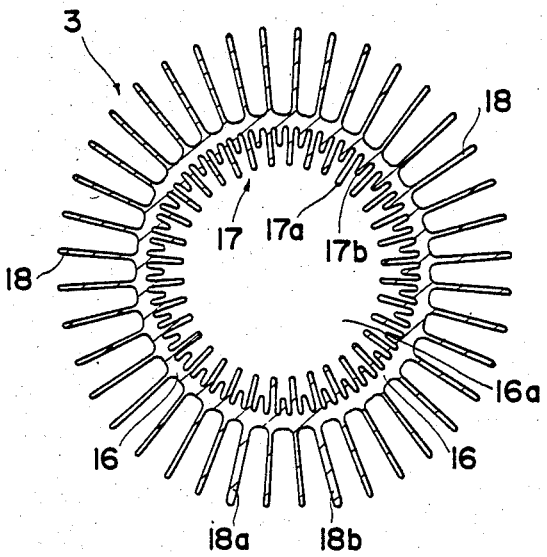
FIG. 2 is a transverse cross-sectional view of the heat exchanger shown in FIG. 1.
Figure 3:
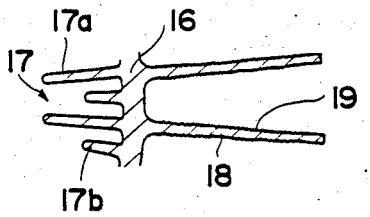
FIG. 3 is an enlarged view of a portion of the heat exchanger of FIG. 2.
Figure 4:
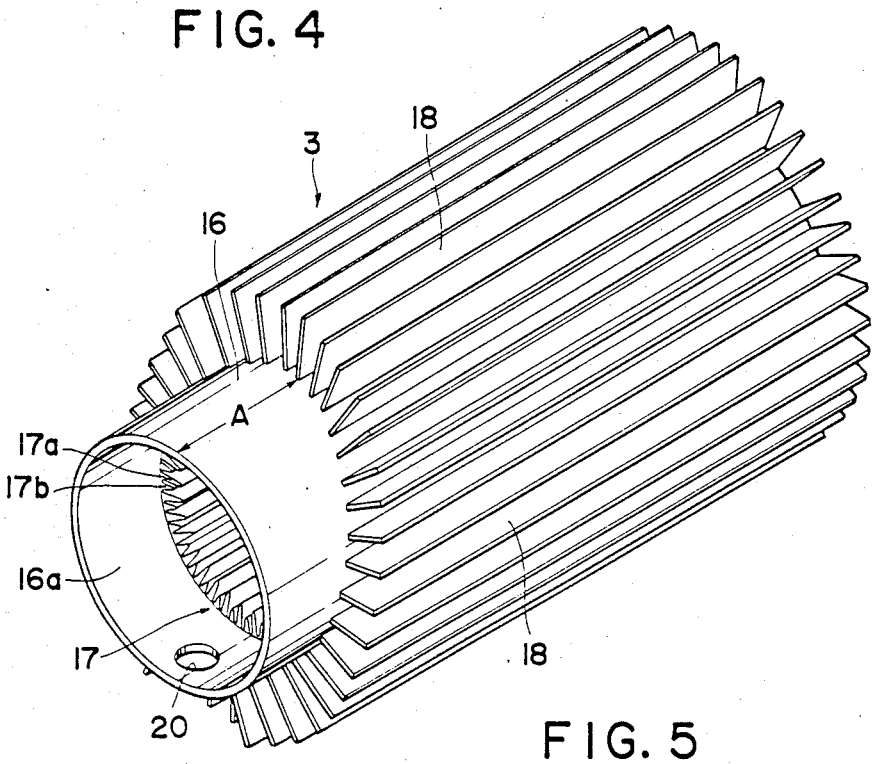
FIG. 4 is a perspective view of the heat exchanger.

The heat exchanger 3 of the present invention is connected at its one end (lefthand in FIG. 1) to the combustion device 2 and comprises an elongate tubular element disposed around a substantial part of the combustion tube 6. As shown in FIGS. 2 through 4, the heat exchanger element 3 includes a tubular body 16, a plurality of interior fins 17 extending longitudinally of the tubular body 16 and projecting integrally radially inwardly from the inner periphery of the tubular body 16, and a plurality of exterior fins 18 extending longitudinally of the tubular body 16 and projecting integrally radially outwardly from the outer periphery of the tubular body 16. The heat exchanger element 3 is made of a one-piece extruded material. Each of the interior and exterior fins 17, 18 has a substantially oblong transverse cross-sectional shape.

The interior fins 17 are not uniform in height and they are comprised of alternate large and small fins 17*a*, 17*b* of different heights, the small fins 17*b* being half the height of the large fins 17*a*. According to the illustrated embodiment, the tubular body 16 has an inside diameter of 70 mm, the large or higher fins 17*a* have a height of 10 mm while the height of the smaller fins 17*b* is 5 mm, a total of 72 interior fins 17*a*, 17*b* being provided on the tubular body 16. The heat exchanger element 3 having such alternately arranged higher and lower fins 17*a*, 17*b* has a large heat transer surface area and can be manufactured easily and at a lesser cost. To increase the heat exchange efficiency, it is preferable to increase the number of the fins. The number of the fins is however limited depending on the strength of a die used for extruding the heat exchanger element. Experience indicated that an attempt to provide interior fins of even height on a tubular body of 70 mm inside diameter was made. However, the number of such interior fins on a resultant heat exchanger element has to be 60% or less of the number of the interior fins 17*a*, 17*b* of different heights.

The number of the exterior fins 18 of the illustrated embodiment is 40 and the height of the fins 18 is about 25 mm. As shown in FIG. 4, the exterior fins 18 are offset from the left end of the tubular body 16 by a suitable distance A. The distance A has a maximum value at a portion of the tubular body 16 which is located in alignment with an air inlet 23 (described later), the distance A being progressively reduced toward a diametrically opposite portion of the tubular body 16 where a combustion gas discharge opening 20 is defined. Several exterior fins 18 which are located adjacent to the discharge opening 20 are offset to a greater extent so as to clear the discharge opening 20 (FIG. 1). Such offset distance A is provided after the extrusion of a heat exchanger element blank which initially has exterior fins along its entire length. As shown in FIG. 3, the exterior fins 18 have roughened or corrugated surfaces 19 defined by alternate ridges and grooves extending longitudinally along the length of the fins 18. With such corrugated surfaces 19, it is possible to increase the heat transfer surface area of the heat exchanger element 3. As shown in FIG. 2, two of the exterior fins 18*a*, 18*b*, which are located at a lower side of the tubular body 16 with two fins 18 interposed therebetween, are thicker than the remaining fins 18. These four fins 18*a*, 18*b*, 18 have respective outer edges lying flush with one another. With this arrangement, the exterior fins 18 are protected from deformation which would otherwise occur during the extrusion work of the heat exchanger element 3.

The heat exchanger element 3 thus constructed is connected to the combustion device 2 with its left and fitted over the air intake tube 5, the other end of the element 3 being closed by a cover plate 15. The combustion tube 8 is received in an interior space 16*a* of the heat exchanger element 3 with its open end located near the cover plate 15 and with its outer surface extending close to the outer edges of the higher interior fins 17*a* of the heat exchanger element 3. With this arrangement, the hot combustion gases flow from the combustion chamber 6*a* through the open end of the combustion tube 6 into an annular space defined between the tubular body 16 and the combustion tube 6, as indicated by the arrows in FIG. 1. In the annular space, the combustion gases flow leftwardly toward the discharge opening 20 through spaces between adjacent interior fins 17 and then are discharged outside of the combustion heater 1 thourgh a discharge passage 22. The casing 4 is shaped so as to surround the heat exchanger element 3 with a slight clearance between the outer edges of the exterior fins 18 and an annular side wall of the casing 4. The air inlet 23 is defined at one end of the casing 4. At the other end of the casing 4, there is provided an air outlet 24. The air is introduced through the air inlet 23 into an annular space defined between the heat exchanger element 3 and the casing 4. Then the air flows rightwardly toward the air outlet 24 through spaces between adjacent exterior fins 18. During that time, the air is subjected to heat exchange relationship between the hot combustion gases through the heat exchanger element 3. The air which has received from heat from the hot combustion gases is finaly discharged from the air outlet 24.

Figure 5:
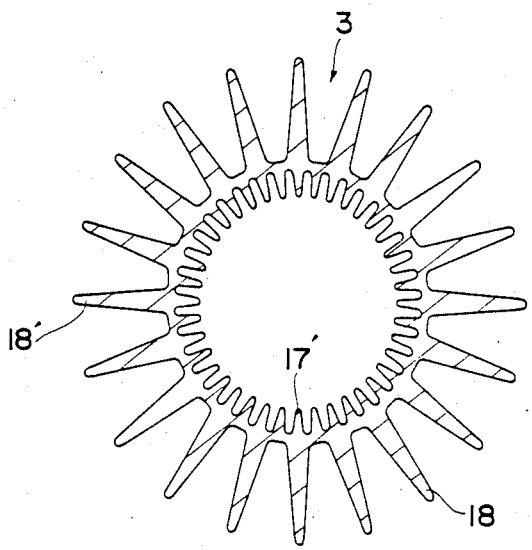
FIG. 5 is a view similar to FIG. 2, but showing another embodiment.

A modified heat exchanger element shown in FIG. 5 is similar to the heat exchanger element 3 of FIGS. 1 through 6 but differs therefrom in that interior fins 17′ and exterior fins 18′ are tapered and each have a substantially triangular transverse cross-sectional shape and the same height. Each of the interior and exterior fins 17′, 18′ is thicker than the corresponding fin 17 or 18 of the foregoing embodiment. The heat exchanger element of this embodiment is also manufactured by extrusion process. The heat transfer surface area of this heat exchanger element is smaller than that of the heat exchanger element 3 of FIG. 2. However, a higher heat transfer coefficient is achieved than in the heat exchanger element 3.

As described above, the heat exchanger element of this invention comprises a one-piece extruded element having interior and exterior fins formed integrally with the body of the element. With this integral formation, the heat exchanger element has a high heat transfer coefficiency which provides a high heat exchange efficiency. With such a heat exchanger element, a compact and light weight combustion heater is achieved. The heat exchanger element can be manufactured easily by a single extrusion process.

Obviously, many modifications and variations of the present invention are possible in the light of the above teachings. It is therefore to be understood that within the scope of the appended claims, the invention may be practiced otherwise than as specifically described.

What is claimed is:

1. A heat exchanger for a combustion heater for effecting heat exchange between air and combustion heat generated by a combustion element of said combustion heater, said heat exchanger comprising:

an extruded heat exchanger element comprising a tubular body, a plurality of interior long and short fins alternately disposed around the inner periphery of said tubular body and integral therewith, each of said interior fins extending in a radial direction from said inner periphery towards the central axis of said tubular body, a plurality of thin exterior fins disposed around the outer periphery of said tubular body and integral therewith, each of said thin exterior fins extending in a radial direction from said outer periphery away from the central axis of said tubular body, said plurality of exterior fins having roughened outer surfaces so as to have an increased surface area for increasing the heat exchanging capacity thereof, and at least two thick exterior fins disposed on the outer periphery of said tubular body and integral therewith, each of said thick exterior fins extending in a radial direction from said outer periphery away from the central axis of said tubular body at positions spaced from positions on said outer periphery wherefrom said thin fins extend, said thick fins being spaced apart on said outer periphery for having their free ends when they rest on a flat planar support, support said tubular body above the flat planar support, and said thick exterior fins being thicker than said thin exterior fins for protecting said thin exterior fins from deforming during the extrusion of said heat exchanger element.

2. A heat exchanger as claimed in claim 1 wherein, said interior long fins extend twice as far towards said central axis as do said interior short fins.

3. A heat exchanger as claimed in claim 1 wherein, each of said interior fins and said exterior fins has an oblong cross-sectional shape.

4. A heat exchanger as claimed in claim 1 wherein, each of said interior fins and said exterior fins are tapered in the direction in which they extend.

5. A heat exchanger as claimed in claim 1 wherein, at least one thin exterior fin is disposed between said adjacent thick exterior fins, said at least one thin interior fin and said thick exterior fins having free ends all lying in a common plane.

* * * * *